US006626762B1

(12) United States Patent
Yabushita et al.

(10) Patent No.: US 6,626,762 B1
(45) Date of Patent: Sep. 30, 2003

(54) GAME DEVICE

(75) Inventors: Tatsuhisa Yabushita, Yokohama (JP); Kenichi Muramatsu, Yokohama (JP); Masatoshi Takai, Tokyo (JP); Hiroshi Fujita, Kawasaki (JP); Yasuhiro Wakatsuki, Sagamihara (JP)

(73) Assignee: Namco, Ltd., Tokyo (JP)

( * ) Notice: Subject to any disclaimer, the term of this patent is extended or adjusted under 35 U.S.C. 154(b) by 0 days.

(21) Appl. No.: 09/700,507

(22) PCT Filed: Mar. 17, 2000

(86) PCT No.: PCT/JP00/01652

§ 371 (c)(1),
(2), (4) Date: Nov. 14, 2000

(87) PCT Pub. No.: WO00/56404

PCT Pub. Date: Sep. 28, 2000

(30) Foreign Application Priority Data

Mar. 19, 1999 (JP) ..... 11-76048

(51) Int. Cl.[7] ..... A63F 9/24
(52) U.S. Cl. ..... 463/49; 463/52
(58) Field of Search ..... 463/1–2, 5, 30–31, 463/36, 49–57; 434/11, 16–20, 21, 22, 23, 307 R

(56) References Cited

U.S. PATENT DOCUMENTS

| | | | | |
|---|---|---|---|---|
| 3,008,712 | A | * | 11/1961 | Konopka |
| 4,102,532 | A | * | 7/1978 | Van Jepmond et al. |
| 4,695,058 | A | * | 9/1987 | Carter |
| 5,785,592 | A | * | 7/1998 | Jacobson |

FOREIGN PATENT DOCUMENTS

| | | | |
|---|---|---|---|
| JP | 50-114099 | A | 9/1975 |
| JP | 167560/1985 | | 5/1987 |
| JP | 4-29648 | Y2 | 7/1992 |
| JP | 6-159998 | A | 6/1994 |
| JP | 7-289737 | A | 11/1995 |
| JP | 8-26053 | A | 1/1996 |

* cited by examiner

*Primary Examiner*—Mark Sager
(74) *Attorney, Agent, or Firm*—Faegre & Benson LLP

(57) ABSTRACT

A game device in which a game can be started in accordance with the intention of a player is provided.

The game device comprises sensors 15 for detecting whether or not a gun type input member 11 is in a stand-by state and a sensor for detecting whether or not targets 3, 4 and 5 are hit, and a time required until the targets 3, 4 and 5 are hit after the gun type input member 11 gets out of a stand-by state is counted.

23 Claims, 7 Drawing Sheets

GAME DEVICE

TECHNICAL FIELD

The present invention relates to a game device suitable for a game, particularly for a quick shooting game in which an input operating member operated by a player is provided so that a player competes with another player for a rapidity in time after the start of the operation of the input operating member until the completion of a prescribed operation.

BACKGROUND ART

There have been hitherto known many shooting game devices employing gun type input members or the like. In these shooting game devices, have been proposed various kinds of games in which a player competes with another player for time required for them to hit a target. In such game devices, time taken until the player hits the target after he operates the gun type input member has been counted. The starting point of counting has been based on a signal of a voice, light, etc. from the game devices.

However, in the above described game devices, the start of the game was dependent upon machines, so that the player could not start the game in accordance with his intention.

With the above described conventional circumstances taken into consideration, it is an object of the present invention to provide a game device in which a player can start a game depending on his intention.

DISCLOSURE OF INVENTION

In order to achieve the above described object, according to the present invention, there is provided a game device in which an input operating member operated by a player is provided so that a player competes with another player for a rapidity in time until a prescribed action is completed after the operation of the input operating member is started; the game device comprising: a means for detecting whether or not the input operating member is in a stand-by state; and a means for detecting whether or not the prescribed action is completed, characterized in that time required until the prescribed action is completed after the input operating member gets out of a stand-by state.

According to this configuration, since the input operating member gets out of its stand-by state in accordance with the operation of a player, a game can be substantially started in accordance with the intention of the player and a time required until a prescribed action is completed can be counted.

Further, for achieving the above described object, according to the present invention, there is provided a game device in which an input operating member operated by a player is provided so that a player competes with another player for a rapidity in time until a prescribed action is completed after the operation of the input operating member is started; the game device comprising: a means for detecting whether or not the input operating member is in a stand-by state, a target actuator for actuating a target member as an object for the operation of the input operating member and a means for detecting whether or not the prescribed action is completed, characterized in that the target member starts its operation through the target actuator when the input operating member gets out of its stand-by state.

According to this configuration, when the input operating member gets out of its stand-by state in accordance with the operation of the player, such actions as the appearance of hidden targets or the commencement of movement of targets can be started.

Further, in the present invention, the stand-by state of the input operating member is preferably a state in which the input operating member is held in a holder part.

According to this configuration, when the input operating member is pulled out from the holder part, a game leaving the stand-by state can be obtained.

Further, in the present invention, the stand-by state of the input operating member is effectively a state in which the input operating member is directed to a predetermined direction different from a direction upon its operating state.

According to this configuration, for instance, if the input operating member is directed downward, it can be brought into a stand-by state, and if the input operating member is directed horizontally, it can be brought into an operating state.

Still further, according to the present invention, the means for detecting whether or not the input operating member is in a stand-by state is preferably a sensor for detecting whether or not the input operating member provided in the holder part is present.

Still further, according to the present invention, effectively, a plurality of sensors are provided and the sensors are provided in different positions of the holder part.

According to this configuration, an accuracy in detecting whether or not the input operating member is in a stand-by state is improved so that an erroneous detection of the stand-by state of the input operating member due to an object other than the input operating member can be reduced.

Still further, in the present invention, at least one of a plurality of sensors is preferably a sensor whose detecting system is different from those of other sensors.

According to this configuration, an accuracy in detecting whether or not the input operating member is in a stand-by state is more improved so that an erroneous detection of the stand-by state of the input operating member due to an object other than the input operating member can be assuredly prevented.

Still further, in the present invention, the means for detecting whether or not the input operating member is in a stand-by state is preferably a sensor for detecting an inclination provided in the input operating member.

According to this configuration, if the input operating member is directed downward, the stand-by state of the input operating member can be realized, and if the input operating member is directed horizontally, the operating state of the input operating member can be realized.

Still further, according to the present invention, effectively, the input operating member is a gun type input member and a time required until the target member is hit after the gun type input member leaves a stand-by state is counted.

According to this configuration, a game device can be provided in which a quick shooting action can be started in accordance with the intention of the player.

Furthermore, in the present invention, the sensor is preferably a sensor for detecting light applied from the gun type input member.

According to this configuration, an accuracy in detecting whether or not the input operating member is in a stand-by state can be assuredly improved.

EMBODIMENTS FOR CARRYING OUT THE INVENTION

Now, embodiments of the present invention will be described by referring to the accompanying drawings.

Figure 1:
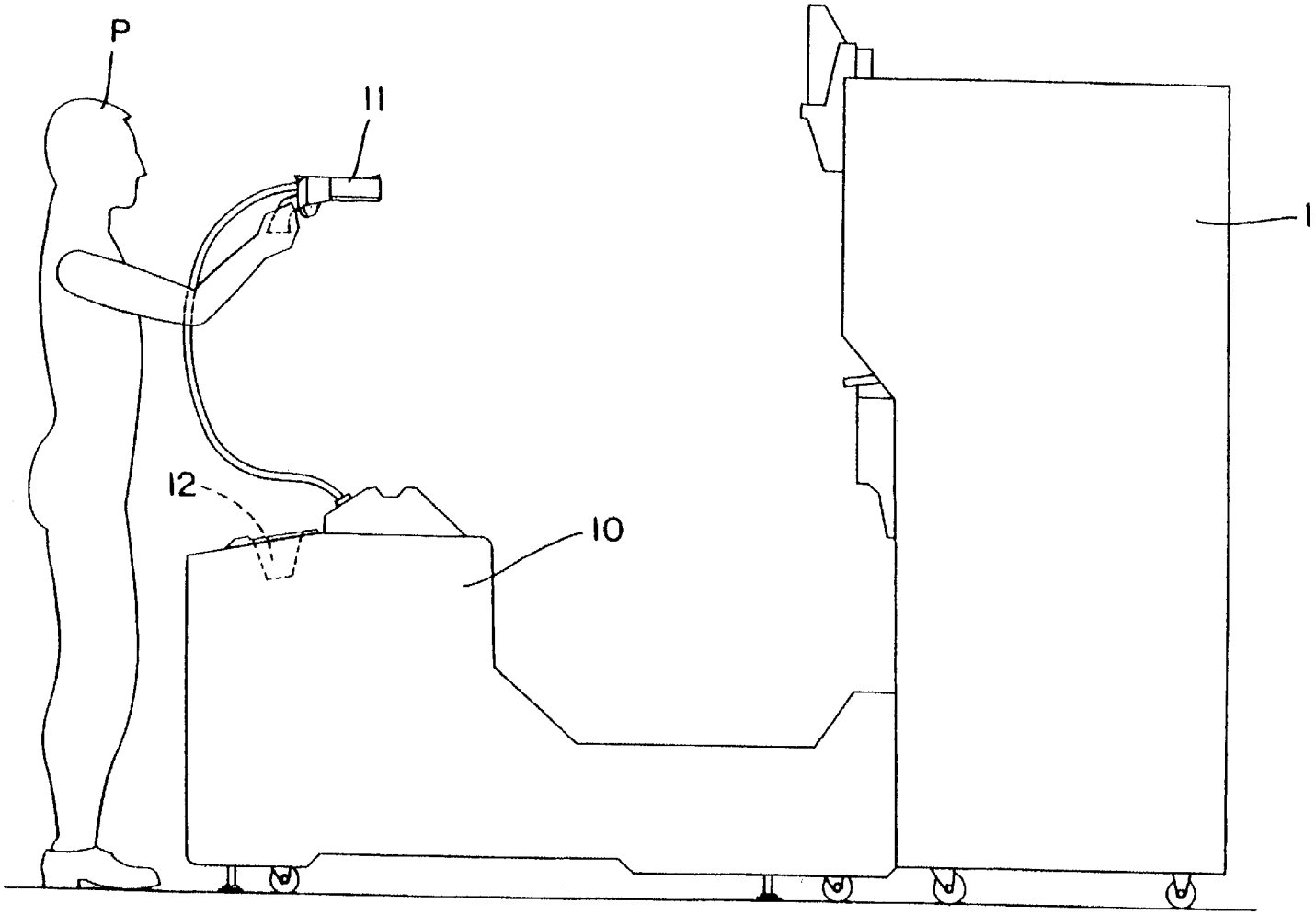
FIG. 1 is a side view showing one embodiment of a game device according to the present invention.
Figure 2:
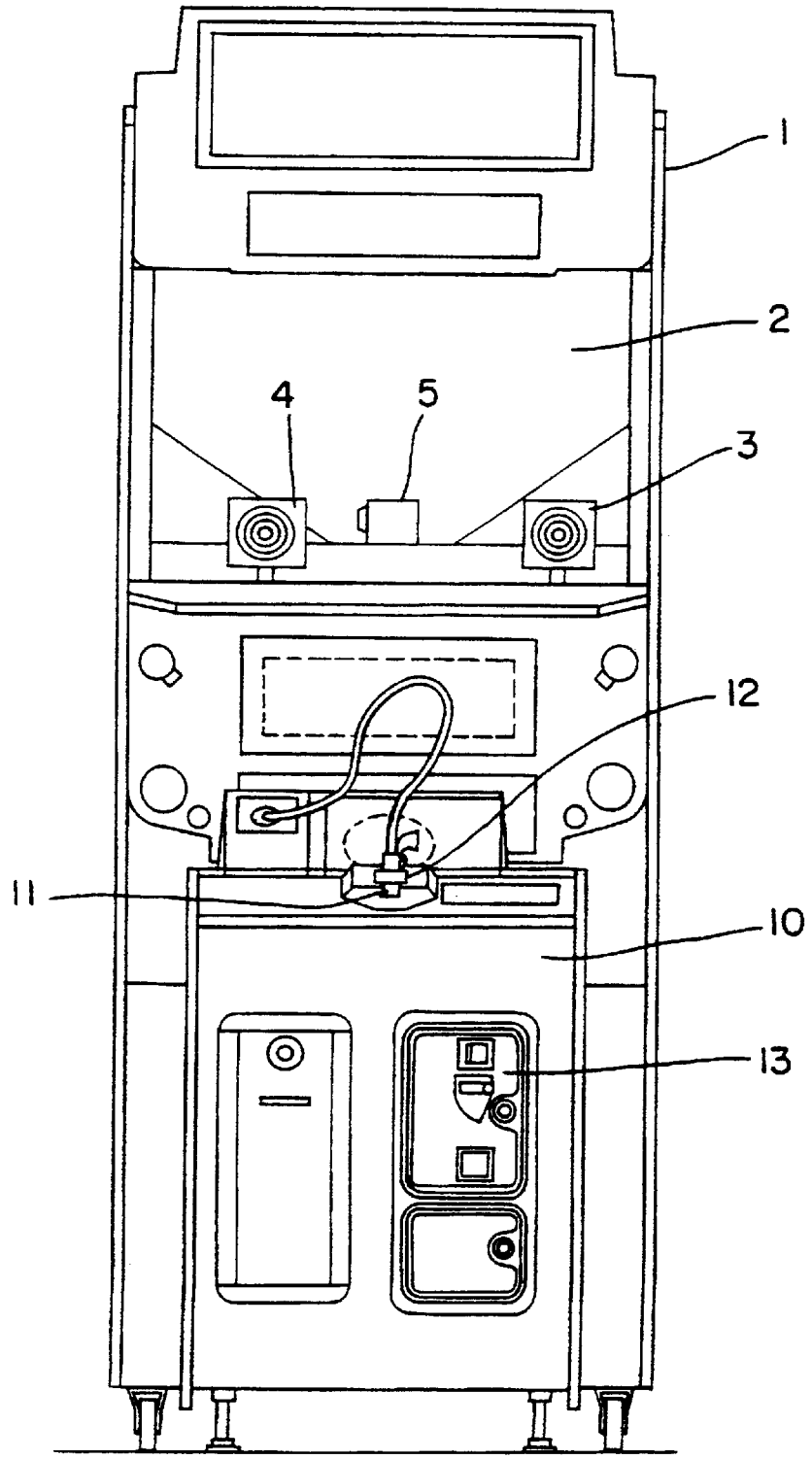
FIG. 2 is a front view of FIG. 1.

FIG. 1 is a side view showing the entire configuration of a shooting game device as one example of a game device according to the present invention. FIG. 2 is a front view of FIG. 1.

In FIGS. 1 and 2, the shooting game device according to this embodiment is provided with two casings 1 and 10. The first casing 1 is provided with a display window 2 on a front surface side, that is to say, on a surface opposed to player P. Targets 3, 4 and 5 are provided inside the display window 2. On the other hand, the second casing 10 is provided with a gun type input member 11 as an input operating member operated by the player P. The first casing 1 and the second casing 10 are arranged in parallel so that the first casing 1 is provided in an interior side in front of the second casing 10 viewing from the player P. The targets provided in the first casing 1 are two target plates 3 and 4 and a cup 5 which are actuated by a target actuator 6 which will be described below.

In the second casing 10, a holder part 12 for housing the gun type input member 11 is formed in the upper part thereof. Further, a coin device 13 is provided in the front surface side of the second casing. The gun type input member 11 is a light beam gun for suitably emitting or applying a beam of light, for instance, a xenon beam light when the trigger of the gun type input member is pulled. The above described targets 3 to 5 are provided with hit detecting sensors (not shown) for sensing the beam of light emitting from the gun type input member 11 as means for detecting whether or not a prescribed action is completed.

Figure 3:
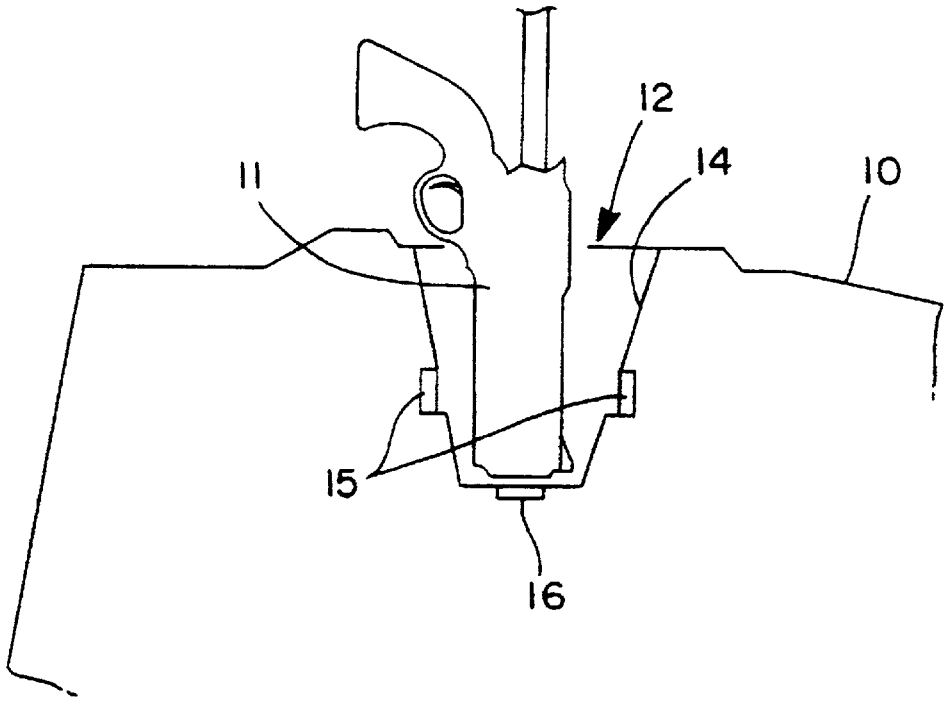
FIG. 3 is an explanatory view showing the configuration of a holder part.

In the above described holder part 12, a recessed part 14 into which the gun barrel side of the gun type input member 11 is provided in the upper part thereof, as shown in FIGS. 1 and 3. In the recessed part 14, sensors 15 for detecting whether or not the gun type input member 11 is present are provided. The sensors 15 in the present embodiment is a light transmitting type sensors comprising a light emitting element and a light receiving element. When the gun type input member 11 is inserted into the holder part 12, the light of the light emitting element of the sensors 15 is interrupted so that the gun type input member 11 is detected.

Figure 4:
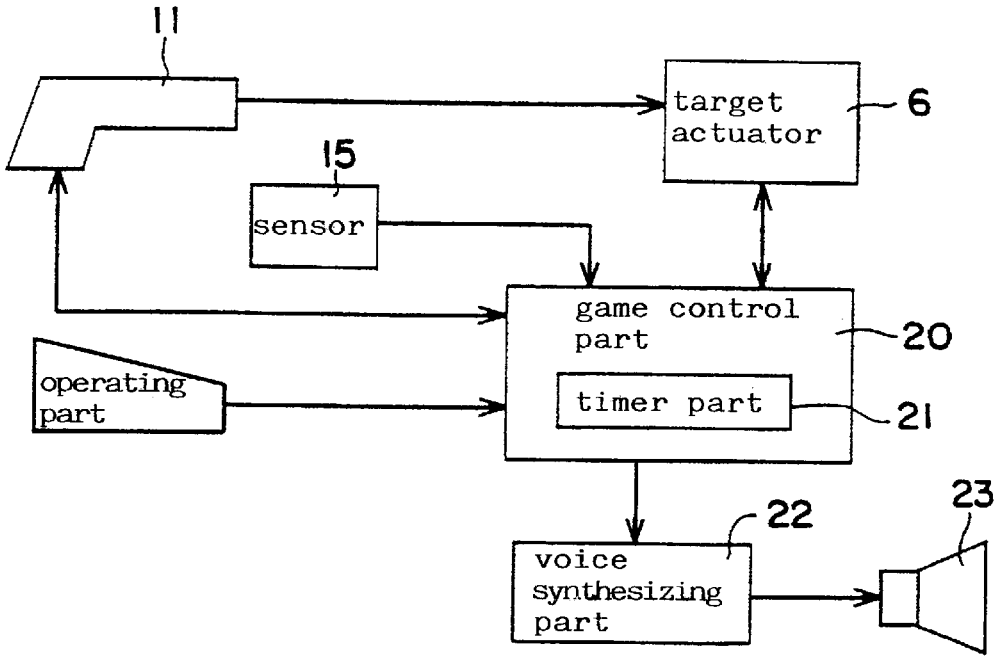
FIG. 4 is a block diagram showing a control system of the game device according to the present invention.

FIG. 4 is a block diagram showing the structure of a circuit of a controller in the game device. The controller is provided with a game control part 20 for performing a control in accordance with a prescribed program. The game control part 20 includes a timer part 21 having a timer function. The game control part 20 is designed to make the device ready for a game in response to a signal when a prescribed coin is inserted into the coin device 13 or a suitable signal of an operating part such as a start button.

Under a state in which the game is being prepared, the target actuator 6 for actuating the targets 3 to 5 keeps stopping. According to this embodiment, as long as the target actuator 6 does not operate, the targets 3 to 5 do not appear on the display window 2 Under the game preparing state, it is decided whether or not the sensors 15 detect the gun type input member 11. When the sensors 15 do not detect the gun type input member 11, the gun type input member 11 is instructed to be inserted into the holder part 12 in accordance with a voice from a speaker 23 through a voice synthesizing part 22 or a display lamp or the like. Further, when the gun type input member 11 is already inserted into the holder part 12, the sensors 15 are turned on, so that the player P is informed about a fact that he can start a game at any time. A state in which the gun type input member 11 is already inserted into the holder part 12 indicates a stand-by state according to the present embodiment under which the game can be started at any time.

Under this stand-by state, when the player P pulls out the gun type input member 11 from the holder part 12, a play is started. At this time, the game control part 20 receives a signal indicating that the sensors 15 are turned off to actuate the timer and actuate the target actuator 6. In this game device, the levels of four-stages are set. In the level 1, either the target plate 3 or the target plate 4 appears in its stationary state. Then, when one of the appearing target plates 3 and 4 is hit, the timer is stopped in accordance with the on-signal of the hit detecting sensor to count time required until the target plate is hit. The counted time is displayed together with the rank of the player among, for instance, 100 persons in the past at the time of the level 1 on a display part not shown. Then, the play shifts to a level 2.

In the level 2, after the player returns the gun input member 11 is again to the holder part 12, the play is started similarly to the level 1. At this time, the two target plates 3 and 4 appear in their stationary states.

When the player clears the level 2, the consumed time and the rank of the player in the level 2 and the total time obtained by adding the time of the level 1 to the consumed time of the level 2 and its rank are displayed. The level 3 is substantially the same as the level 2 and is different from the level 2 only from the viewpoint that the appearing target plates 3 and 4 move in parallel at random.

After the player clears the level 3 to shift to a level 4, when the player pulls out the gun type input member 11 from the holder part 12, the target actuator 6 is actuated so that the cup 5 appears. When the player hits the cup 5, an explosion display that the cup 5 is broken to pieces is represented. However, since the explanation thereof does not constitute the gist of the present invention, it will be omitted.

Thus, when the player clears all the levels from the level 1to the level 4, the game is finished. Then, the rank or the clear time of the player P are displayed so that the player P recognizes his results or the like.

In the game device configured as mentioned above, when the gun type input member 11 is pulled out from the holder part 12, the target actuator operates so that the targets appear and a game is substantially started. Therefore, the player P can start the game in accordance with his intention.

In the game device of the invention, since the substantial start of the game device is set after the gun type input member 11 is pulled out from the holder part 12, as long as the player P does not start a play, a stand-by state is continued. In order to avoid such a problem, in this game device, a total time after a coin is inserted into the game device is properly limited. Further, the number of shootings is properly limited.

According to the present embodiment, the light transmitting type sensors 15 are provided in the holder part 12. In this configuration, however, if the gun type input member 11 is previously directed to the target and the sensors 15 are interrupted by a free hand or the like, it will be decided that the gun type input member is in a stand-by state. Under this state, if the game is started, it may be more highly possible for the player to hit the target in a short time than a case where the player pulls out the gun type input member from the holder part 12 to shoot the target.

In order to improve this problem, as shown in FIG. 3, while the sensors 15 are provided in the holder part 12 as first sensors, a second sensor 16 different from them is provided. The second sensor 16 is a light receiving sensor arranged on the bottom part of the holder part 12 and adapted to be turned on when it is irradiated with a beam of light from the gun type input member 11.

In such a configuration, as long as the gun type input member 11 is not correctly inserted into the holder part 12, the gun type input member is not brought into a stand-by state. Therefore, the above mentioned problem is not generated. As the second sensor 16, may be employed a sensor whose detecting system is different from that of the light receiving sensor in place of the light receiving sensor, for instance, a magnetic sensor for detecting a magnet provided in the gun type input member 11 or a microswitch turned on when it is pressed by the gun type input member 11. As described above, the second sensor may be preferably a sensor of a type different from the first sensors. Further, a plurality of light transmitting type sensors may be all selectively located at positions hardly interrupted by a hand.

Figure 5:
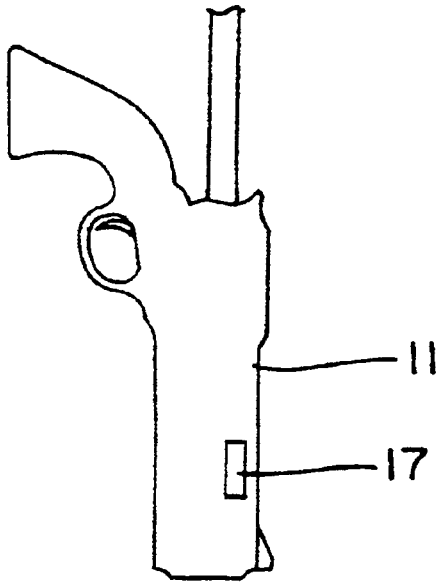
FIG. 5 is a diagram showing another embodiment of a game device according to the present invention.
Figure 6:
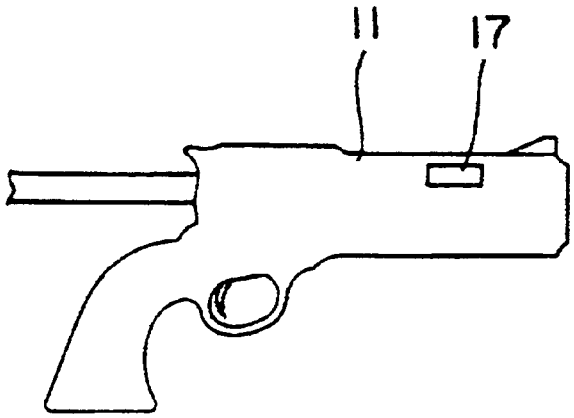
FIG. 6 is a diagram showing the position of a gun type input member after the operation thereof in FIG. 5.
Figure 7:
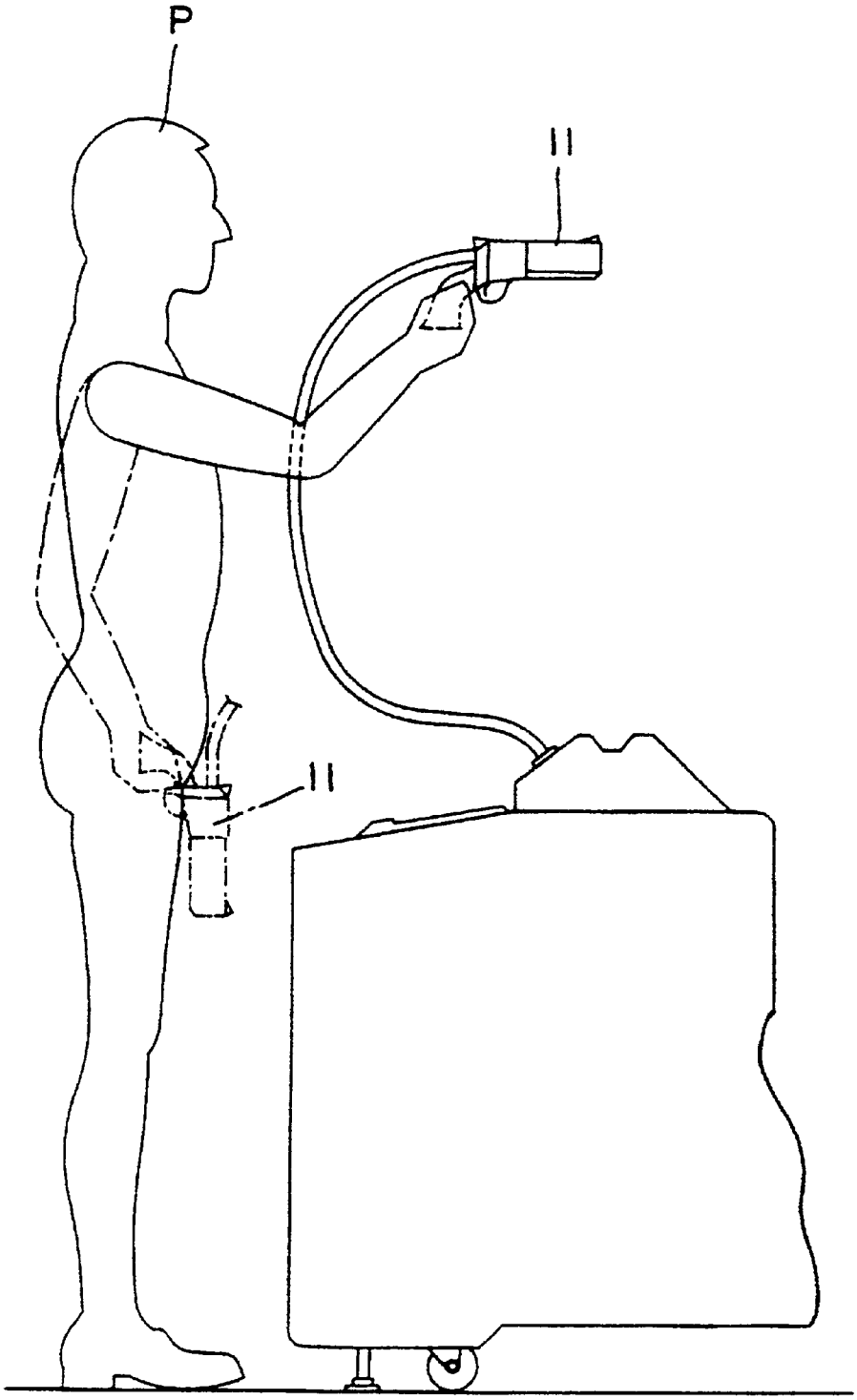
FIG. 7 is a diagram showing a playing manner in the embodiment shown in FIG. 5.

FIG. 5 is an explanatory view showing another embodiment of the present invention. In this embodiment, an inclination sensor 17 is incorporated in a gun type input member 11. This inclination sensor 17 is designed to be turned off when the gun type input member 11 is directed to a prescribed direction and to be turned on when the direction is changed. Thus, the inclination sensor 17 is set to be turned off when the gun barrel of the gun type input member 11 is directed substantially just downward, in other words, directed substantially vertically, and to be turned on when the direction of the gun barrel is changed horizontally as shown in FIG. 6. Setting in such a manner, when a player P turns the gun barrel of the gun type input member 11 downward as shown by a chain line in FIG. 7 and then, he moves the gun barrel so as to take aim at a target as shown in a solid line in FIG. 7, the inclination sensor 17 is switched from turning-off to turning-on. Thus, a target actuator 6 is adapted to be actuated and a timer is adapted to be turned on in response to a signal.

According to the above described configuration, the player can start a game in accordance with his intention without using the holder part. In this connection, the game device may be applied to a game in which the player P wears a gun belt and a time until he hits the target after he pulls out the gun type input member 11 from the gun belt is measured. At this time, a sensor may be provided in the holder of the gun belt. The above described inclination sensor may be advantageously used, because a detection device does not need to be provided in the gun belt.

Although the preferred embodiments of the present invention are described in the foregoing, it should be noted that the present invention is not limited to the above embodiments and various kinds of modifications can be made. For example, according to the above embodiments, although the gun type input member is employed as the operating input member, the operating input member may be a sword, and, in this case, the game device can be applied to a game in which a rapidity is fought such as a swordplay.

Figure 8:
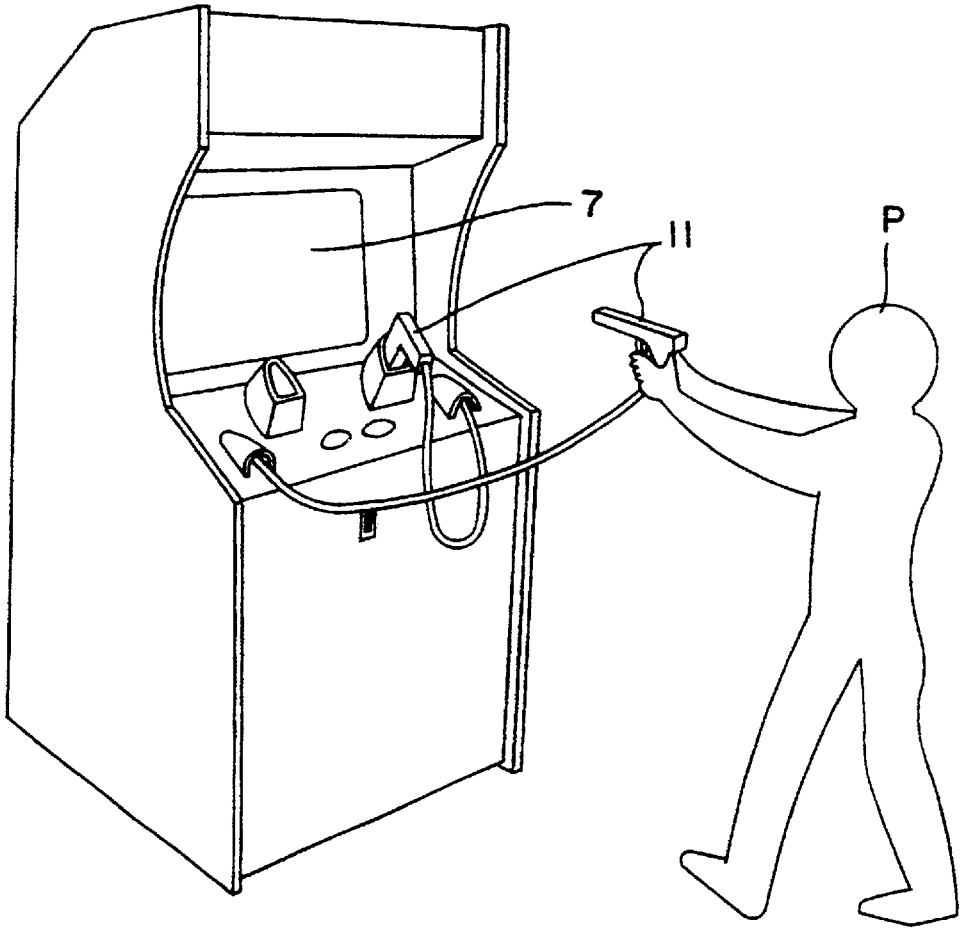
FIG. 8 is a diagram showing a still another embodiment of a game device according to the present invention.

Further, according to the above embodiments, although a mechanical mechanism is employed as a target by actually using an article, it should be noted that a target displayed on a CRT 7 may be shot as shown in FIG. 8. Further, according to the present invention, two gun type input members 11 may be provided as shown in FIG. 8 so that the player P can select the use of two gun type input members or the use of one input member.

What is claimed is:

1. A game device comprising:

an input operating member operated by a player competing with another player for a rapidity in time after the operation of the input operating member is started until a prescribed action is completed, a means for detecting whether or not the input operating member is in a stand-by state, a target actuator for actuating a target member as an object for the operation of the input operating member, and a means for detecting whether or not the prescribed action is completed, characterized in that the target member starts operation through the target actuator when the input operating member gets out of a stand-by state.

2. A game device according to claim 1, characterized in that the target member not appear on a display when the input member is in a stand-by state and the target member appear on the display when the input operating member gets out of a stand-by state.

3. A game device according to claim 2, characterized in that the stand-by state of the input operating member is a state in which the input operating member is held in a holder part.

4. A game device according to claim 2, characterized in that the stand-by state of the input operating member is a state in which the input operating member is directed to a predetermined direction different from a direction in an operating state.

5. A game device according to claim 2, characterized in that the means for detecting whether or not the input operating member is in a stand-by state is a sensor for detecting an inclination provided in the input operating member.

6. A game device according to claim 2, characterized in that the input operating member is a gun and a time required until the target member is hit after the input operating member leaves a stand-by state is counted.

7. A game device according to claim 1, characterized in that the stand-by state of the input operating member is a state in which the input operating member is held in a holder part.

8. A game device according to claim 7, characterized in that the means for detecting whether or not the input operating member is in a stand-by state is a sensor for detecting whether or not the input operating member provided in the holder part is present.

9. A game device according to claim 7, characterized in that the input operating member is a gun and a time required until the target member is hit after the input operating member leaves a stand-by state is counted.

10. A game device according to claim 1, characterized in that the stand-by state of the input operating member is a state in which the input operating member is directed to a predetermined direction different from a direction in an operating state.

11. A game device according to claim 10, characterized in that the means for detecting whether or not the input operating member is in a stand-by state is a sensor for detecting an inclination provided in the input operating member.

12. A game device according to claim 10, characterized in that the input operating member is a gun and a time required until the target member is hit after the input operating member leaves a stand-by state is counted.

13. A game device according to claim 1, characterized in that the means for detecting whether or not the input operating member is in a stand-by state is a sensor for detecting whether or not the input operating member provided in a holder part is present.

14. A game device according to claim 13, characterized in that the sensor is a sensor for detecting light applied from the input operating member.

15. A game device according to claim 13 characterized in that the input operating member is a gun and a time required until the target member is hit after the input operating member leaves a stand-by state is counted.

16. A game device according to claim 13, characterized in that a plurality of sensors are provided and the sensors are provided in different positions of the holder part.

17. A game device according to claim 16, characterized in that the input operating member is a gun and a time required until the target member is hit after the input operating member leaves a stand-by state is counted.

18. A game device according to claim 16, characterized in that the sensor is a sensor for detecting light applied from the input operating member.

19. A game device according to claim 16, characterized in that at least one of said plurality of sensors is a sensor whose detecting system is different from those of other sensors.

20. A game device according to claim 19, characterized in that the sensor is a sensor for detecting light applied from the input operating member.

21. A game device according to claim 1 characterized in that the means for detecting whether or not the input operating member is in a stand-by state is a sensor for detecting an inclination provided in the input operating member.

22. A game device according to claim 1 characterized in that the input operating member is a gun and a time required until the target member is hit after the input operating member leaves a stand-by state is counted.

23. A game device according to claim 22, characterized in that the sensor is a sensor for detecting light applied from the input operating member.

* * * * *